United States Patent [19]

Sugimoto et al.

[11] 4,304,852

[45] Dec. 8, 1981

[54] SILVER HALIDE PHOTOGRAPHIC LIGHT-SENSITIVE MATERIAL

[75] Inventors: Naohiko Sugimoto; Shinzo Kishimoto; Katsumi Ryoke; Masakazu Yoneyama, all of Minami-ashigara; Nobuhisa Sekiguchi, Fujinomiya, all of Japan

[73] Assignee: Fuji Photo Film Co., Ltd., Minami-ashigara, Japan

[21] Appl. No.: 188,783

[22] Filed: Sep. 19, 1980

[30] Foreign Application Priority Data

Sep. 19, 1979 [JP] Japan ..... 54 120438

[51] Int. Cl.[3] ..... G03C 1/78

[52] U.S. Cl. ..... 430/527; 430/528; 430/529; 430/631; 430/634; 430/636; 430/961

[58] Field of Search ..... 430/528, 529, 523, 631, 430/634, 636, 961, 527

[56] References Cited

U.S. PATENT DOCUMENTS

| | | | |
|---|---|---|---|
| 2,639,234 | 5/1953 | Morey et al. | 430/529 |
| 3,811,889 | 5/1974 | Endou et al. | 430/529 |
| 3,843,368 | 10/1974 | Yamamoto et al. | 430/529 |
| 4,013,696 | 3/1977 | Babbitt et al. | 430/528 |
| 4,201,586 | 5/1980 | Hori et al. | 430/631 |
| 4,242,444 | 12/1980 | Habu et al. | 430/529 |

*Primary Examiner*—J. Travis Brown

*Attorney, Agent, or Firm*—Sughrue, Mion, Zinn, Macpeak and Seas

[57] ABSTRACT

A silver halide photographic light-sensitive material is described containing a film-forming water-soluble polymer derived from a monomer including a carboxylic acid group;

a compound of the formula (I)

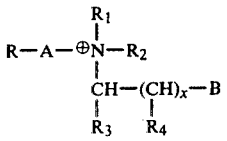

(I)

wherein A is

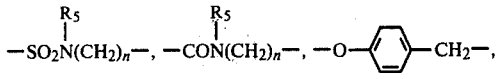

or a chemical bond; R is a saturated or unsaturated hydrocarbon group having from 8 to 22 carbon atoms when A is a chemical bond, and a saturated or unsaturated hydrocarbon group having from 7 to 21 carbon atoms when A is

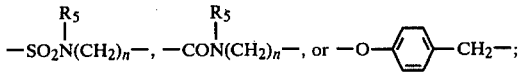

$R_5$ is hydrogen, a methyl group, or an ethyl group; B is $—COO^{\ominus}$ or $—SO_3^{\ominus}$; $R_1$ and $R_2$ are each an alkyl group or hydroxyalkyl group having from 1 to 18 carbon atoms, or a polyalkylene oxide chain group; $R_3$ and $R_4$ are each hydrogen or an alkyl group having from 1 to 4 carbon atoms; n is an integer of from 2 to 8; and x is 0 or 1; and a compound of the formula (II)

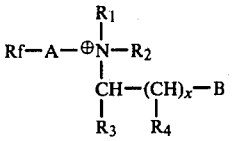

(II)

wherein A, B, $R_1$, $R_2$, $R_3$, $R_4$ and x can have the same meanings as defined for formula (I) above; Rf is a perfluoroalkyl group having from 8 to 22 carbon atoms when A is a chemical bond, and a perfluoroalkyl group having from 7 to 21 carbon atoms when A is

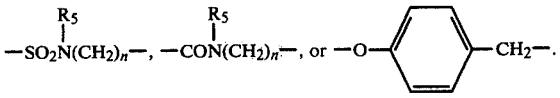

19 Claims, No Drawings

SILVER HALIDE PHOTOGRAPHIC LIGHT-SENSITIVE MATERIAL

BACKGROUND OF THE INVENTION

1. Field of the Invention

This invention relates to silver halide light-sensitive materials, and, more particularly, to silver halide photographic light-sensitive materials wherein static buildup is reduced and the components thereof are transferred in only negligible small amounts to a transport roll or a fluorescent intensifying screen for X-ray photography (hereinafter referred to simply as a "screen").

2. Description of the Prior Art

Static buildup on photographic sensitive materials has long annoyed the photographic industry. Static electricity may be generated during the manufacture and use of photosensitive materials when they are wound on rolls, rewound therefrom, transported on rollers or when they contact other objects in transit. Generation and accumulation of static charges is a product of, for example, the electric conductivity and triboelectric characteristics of the photographic material, moisture, the properties of the contacted object, and the atmosphere in which the contact occurs. Accumulated static electricity sometimes discharges to cause irregular fogging of the photosensitive material. This is so deleterious to the material that it may even completely lose its commercial value. For instance, an X-ray film, even if it experiences the slightest fogging, not only fails to achieve the intended purpose but may result in an inaccurate diagnosis.

It is well known to provide an antistatic layer in a photographic material so as to avoid any adverse effect of static buildup, and many types of photographic materials have been proposed that incorporate an antistatic layer that dissipates static charges. Illustrative examples include U.S. Pat. Nos. 2,649,374, 3,033,679, 3,437,487, 3,525,621, 3,630,740, and 3,681,070, Japanese Patent Publication No. 4380/73 and Japanese patent application (OPI) No. 113221/75 (the term "OPI" as used herein refers to a "published unexamined Japanese patent application"). These references describe various antistats and antistatic layers that contain them. However, these conventional antistatic (antistat) agents or antistatic layers have various serious defects that make them less than totally suitable for use as a component of a photographic sensitive material. For example, due to insufficient antistatic properties, they may be unable to prevent fogging from occurring in a high-sensitivity photographic material; or, the antistatic layer may dissolve in a developing bath to form scum; or, the layer or the photographic material that contains it may be so low in strength that it becomes less abrasion-resistant and durable to the extent that it is no longer of value as a commercial product or may create problems in the production thereof.

To let a certain compound achieve the intended effect as an antistat, it is generally required that the compound be incorporated in a photographic light-sensitive material in a greater amount that when it is used for other purposes, (for example, as a coating aid, emulsifying agent, or sensitizing agent). This is presumably because an antistat must form a continuous layer in order to remain electrically conductive in a photographic layer. However, when the antistat is used in a great amount, much of it remains on the surface of a photosensitive material, causing various problems in the preparation or use of the photosensitive material, since it may be transferred to transport rollers, a camera or screen that contact the surface of the material. For instance, an antistat transferred to a transport roll may stain the roll, and the stain may be deposited on a film that subsequently passes between the rolls. If the antistat is transferred to a screen, the characteristics of the screen may be changed, or a stain or blur may be formed on the X-rayed photographic material. This not only impairs the product quality but may result in an inaccurate diagnosis.

SUMMARY OF THE INVENTION

As a result of extensive studies, it has now been found that a silver halide photographic light-sensitive material containing a film-forming water-soluble polymer derived from a monomer including a carboxylic acid group and compounds of the formulae (I) and (II), as described below, is free from the defects of conventional products.

The compound of the formula (I) can be represented by

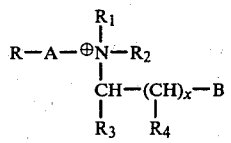

(I)

wherein A is

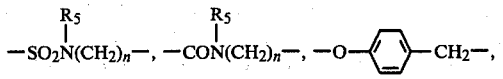

or a chemical bond; R is a saturated or unsaturated hydrocarbon group having from 8 to 22 carbon atoms when A is a chemical bond, and a saturated or unsaturated hydrocarbon group having from 7 to 21 carbon atoms when A is

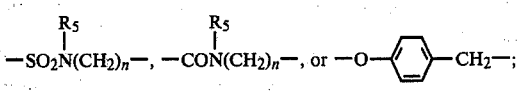

$R_5$ is hydrogen, a methyl group or an ethyl group; B is $-COO^{\ominus}$ or $-SO_3^{\ominus}$; $R_1$ and $R_2$ are each an alkyl group or hydroxyalkyl group having from 1 to 18 carbon atoms, or a polyalkylene oxide chain group; $R_3$ and $R_4$ are each hydrogen, or an alkyl group having from 1 to 4 carbon atoms; n is an integer of from 2 to 8; and x is 0 or 1.

The compound of the formula (II) can be represented by

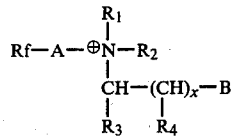

(II)

wherein A, B, $R_1$, $R_2$, $R_3$, $R_4$ and x can have the same meanings as defined for the formula (I) above (but they are not required to be exactly the same as for the formula (I) in each particular case); Rf is a perfluoroalkyl group having from 8 to 22 carbon atoms when A is a chemical bond, and a perfluoroalkyl group having from 7 to 21 carbon atoms when A is

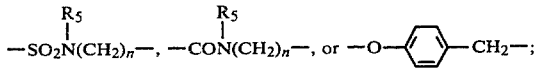

a perfluoroalkyl group as defined in this invention includes a group having hydrogen substituted at the ω-position (see, Compounds (II)-8 and (II)-9 described hereinafter).

There is no particular limitation on the film-forming water-soluble polymer derived from a monomer including a carboxylic acid group (hereunder referred to as a "polymer acid") that is usable in this invention, but homopolymers or copolymers of vinyl monomers including a carboxyl group are used with advantage.

Illustrative preferred polymer acids are those derived from vinyl monomers including a carboxyl group such as acrylic acid, methacrylic acid, maleic anhydride (including maleic acid, half esters, half amides, and other derivatives thereof), cinnamic acid, crotonic acid, citraconic acid, p-carboxystyrene, and vinyl-α-carboxymethyl ether.

Illustrative monomers copolymerizable with the vinyl monomers including a carboxyl group include ethylenic unsaturated monomers such as ethylene, vinyl acetate, styrene, alkyl vinyl ethers such as methyl vinyl ether, acrylate esters (such as ethyl acrylate, butyl acrylate and phenyl acrylate), methacrylate esters (such as ethyl methacrylate, butyl methacrylate and phenyl methacrylate), acrylamide derivatives such as acrylamide acryloyl morpholine, methacrylamide and their derivatives, and vinylpyrrolidine. For the purpose of increasing the physical strength of the antistatic layer, the vinyl monomers may be copolymerized with monomers having a hydroxyl group such as hydroxyethyl acrylate, hydroxyethyl methacrylate and hydroxypropyl acrylate, or monomers having a functional group such as chloromethylstyrene, acetoacetoxyethyl methacrylate and glycidyl acrylate.

The carboxylic acid polymer used in this invention is required to have a molecular weight sufficient to provide a strong cross-linked film. The molecular weight differs from polymer to polymer, but it is generally within the range of from about 5,000 to 500,000, and preferably from about 10,000 to 200,000. Carboxylic acid polymers that can be used with advantage in this invention include the following repeating unit(s):

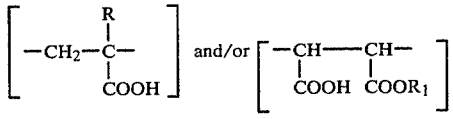

wherein R is hydrogen or a methyl group, and $R_1$ is hydrogen or an alkyl group having from 1 to 5 carbon atoms.

Illustrative polymeric acids that can be used advantageously in this invention are illustrated below by reference to their repeating units:

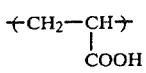

Polymer-1

-continued

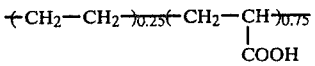

Polymer-2

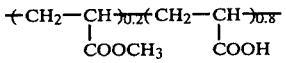

Polymer-3

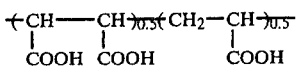

Polymer-4

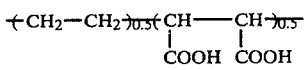

Polymer-5

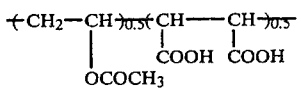

Polymer-6

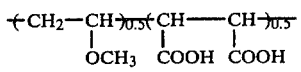

Polymer-7

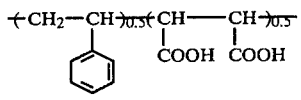

Polymer-8

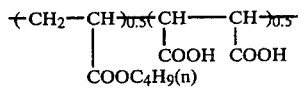

Polymer-9

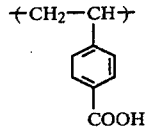

Polymer-10

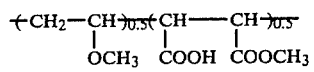

Polymer-11

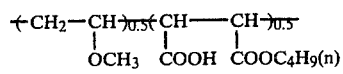

Polymer-12

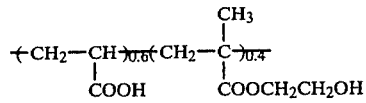

Polymer-13

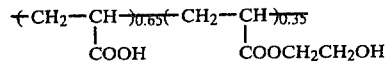

Polymer-14

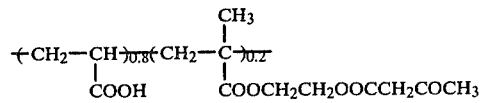

Polymer-15

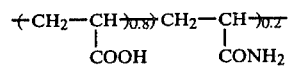

Polymer-16

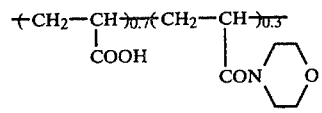

Polymer-17

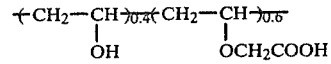

Polymer-18

-continued

Polymer-19

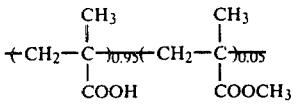

Polymer-20

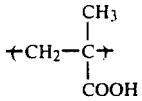

The polymer acid is preferably at least partially neutralized with an alkali. The alkali used is an inorganic or organic base of alkaline earth metals or alkali metals, and preferably it is sodium hydroxide or potassium hydroxide. A preferred degree of neutralization is such that at least 50 mol% of the carboxylic acid group is neutralized, and the pH is between 5.0 and 7.5. The polymer acid is used in this invention in an amount from about 50 mg/m$^2$ to 5 g/m, and preferably from 100 mg/m$^2$ to 1 g/m$^2$.

The compound of the formula (I) is now described in detail. In the formula (I), A is preferably

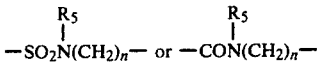

(wherein $R_5$ is preferably hydrogen), B is preferably —COO⊖, $R_1$ and $R_2$ are each preferably an alkyl group having from 1 to 4 carbon atoms, a hydroxyalkyl group having from 2 to 4 carbon atoms, or a polyethylene oxide chain group, $R_3$ and $R_4$ are each preferably hydrogen or a methyl group, and n is preferably an integer of from 2 to 4.

Preferred examples of the compound of the formula (I) are as follows:

Compound (I)-1

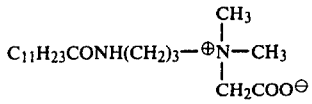

Compound (I)-2

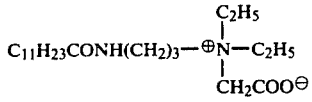

Compound (I)-3

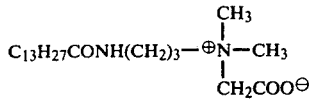

Compound (I)-4

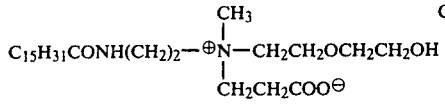

Compound (I)-5

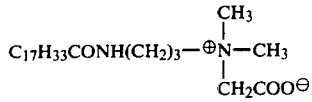

Compound (I)-6

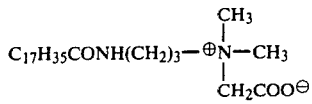

-continued

Compound (I)-7

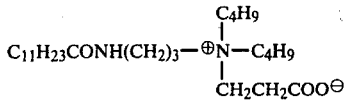

Compound (I)-8

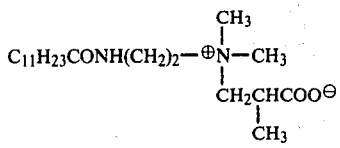

Compound (I)-9

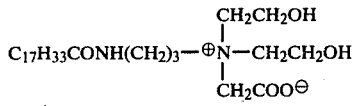

Compound (I)-10

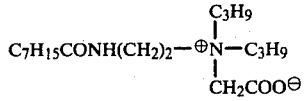

Compound (I)-11

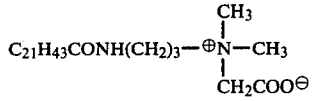

Compound (I)-12

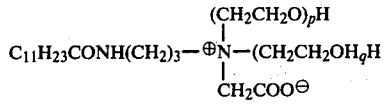

p + q = 5

Compound (I)-13

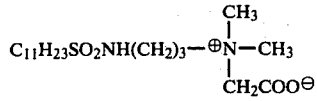

Compound (I)-14

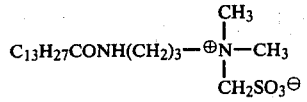

For the synthesis of compounds of the formula (I), see the specification of Japanese Patent Publication No. 5048/75, *Journal of American Chemical Society*, Vol. 67, page 2095 (1947) and U.S. Pat. Nos. 2,777,872, 2,846,417, 3,411,912, 3,832,185 and 4,012,437.

The compound of the formula (I) is generally used in an amount of from about 5 to 500 mg/m$^2$, and preferably from 10 to 200 mg/m$^2$.

The compound of the formula (II) is now described in detail. In the formula (II), A is preferably

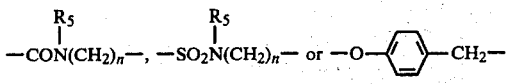

(wherein $R_5$ is preferably hydrogen), B is preferably —COO⊖, $R_1$ and $R_2$ are each preferably an alkyl group having from 1 to 4 carbon atoms, $R_3$ and $R_4$ are each preferably hydrogen, and n is preferably an integer of from 2 to 4.

Preferred examples of the compound of the formula (II) are listed below:

Compound (II)-1

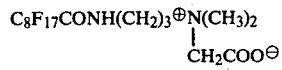

-continued $C_{10}F_{21}CONH(CH_2)_3\oplus N(CH_3)_2$ Compound (II)-2
$\quad\quad\quad In a layer in which the three components of this invention are incorporated together, a carboxylic acid activating condensing agent may also be incorporated to act upon the polymer acid to thereby improve the physical strength of the layer. That is, the carboxylic acid activating condensing agent is preferably incorporated in a layer containing the polymer acid, but may be incorporated in an adjacent layer. Illustrative carboxylic acid activating condensing agents include N-ethyl-5-phenylisoxazolium-3'-sulfonate known as Woorword's Reagent K, N-tert-butyl-5-methylisoxazolium perchlorate known as Woodward's Reagent L, isooxazolium salts as described in Japanese Patent Publication No. 30069/69, U.S. Pat. Nos. 3,060,028, 3,316,095, 3,321,313 and 3,543,292, N,N-dicyclohexylcarbodiimide known as DCC, water-soluble 1-ethyl-3-(3-dimethylaminopropyl)carbodiimide hydrochloride, carbodiimides as described in U.S. Pat. No. 3,619,236 and Japanese Patent Publication No. 38715/71, dihydroquinoline-N-carboxylic acid esters, carbamoylpyridinium salts, carbamoyloxypyridinium salts and 6-chloro-1-p-chlorobenzenesulfonyloxybenztriazole.

A layer containing the components of this invention can be formed by any conventional technique for coating an aqueous coating composition, such as dip coating, air-knife coating, curtain coating, spray hopper coating, and extrusion coating with a slide hopper.

The photosensitive material of this invention is very effective in controlling static buildup as compared with antistatic photographic light-sensitive materials proposed previously and, in addition, no component in the material is transferred, due to contact, onto a transport roller, a camera, or screen. This advantage is particularly great when a high-sensitivity material such as a color negative film or X-ray film constitutes the photosensitive material of this invention.

Suitable supports for these photographic materials include cellulose acetate, cellulose nitrate, polyvinyl acetal, polycarbonate, polyester (e.g., polyethylene terephthalate), polystyrene, and baryta paper as well as photographic paper coated with polystyrene, cellulose acetate, polyester and polyolefin.

The radiation sensitive emulsion layer used in the photographic sensitive material of this invention will hereunder be described. Any type of conventional silver halides, i.e., silver chloride, silver bromide, silver bromoiodide, silver chlorobromide, silver chloroiodide, and silver chlorobromoiodide, may be used as the emulsion. These halides may be used independently or as a mixture. A hydrophilic colloid is generally selected as a binder. Typical examples of the colloid include protein such as gelatin and its derivatives, cellulose derivatives, starch, saccharides, including polysaccharides such as dextran, vegetable rubber, and synthetic polymers such as polyvinyl alcohol, polyacrylamide and polyvinyl pyrrolidone. The photographic sensitive material of this invention may further contain conventional additives such as an anti-foggant, photographic stabilizer, sensitizer, developer additives, curing agent, plasticizer, surfactant, color coupler and polymer latex. For details of these additives, see *Product Licensing Index*, Vol. 92, pp. 107–110 (December, 1971) and *Research Disclosure*, Vol. 176, pp. 22–31 (December, 1978).

For the manufacture and developing of an X-ray film in which a photosensitive material according to this invention can be used, and also describing a screen for use therewith, see *Research Disclosure*, Vol. 184, pp. 433–441 (August, 1979).

This invention is now described in greater detail by reference to the following examples, which are given here for illustrative purposes only and are not intended to limit the scope of the invention.

EXAMPLE 1

Samples (1) through (8), each comprising the combination, in the order written, of a protective layer, emulsion layer, polyethylene terephthalate film base, emulsion layer and a protective layer were prepared by the conventional method of coating and drying. The basic formulations of the protective and emulsion layers were as follows:

Emulsion Layer

Binder: 2.5 g/m$^2$ of gelatin
Silver coating: 5 g/m$^2$
Silver halide: 1.5 mol% of AgI + 98.5 mol% of AgBr
Hardener: 0.8 g of chrome alum per 100 g of binder
Fog restrainer: 0.5 g of 1-phenyl-5-mercaptotetrazole per 100 g of Ag

Protective Layer

Binder: 1.7 g/m$^2$ of gelatin
Hardener: 0.4 g of sodium 2-hydroxy-4,6-dichloro-s-triazine per 100 g of binder
Coating aid: 20 mg/m$^2$ of sodium 4-(p-nonylphenoxy) butanesulfonate
Matting agent: 25 mg/m$^2$ of polymethyl methacrylate (average particle size: 5$\mu$)

Sample (1) used an emulsion layer and a protective layer identical with the above-indicated formulations. Samples (2) through (8) were the same as Sample (1) except that they used a protective layer containing Polymer-1, and Compounds (I)-1 and (II)-1 (wherein 60 mol% of the carboxylic acid group of Polymer-1 was neutralized with sodium hydroxide) in the amounts indicated in Table 1 below. Each sample was evaluated for the control of static buildup, the degree of deterioration of the screen, and the amount of transfer to a roller. Each factor was evaluated by the method set forth below. The results are shown in Table 1.

I. Determination of efficiency in the control of static buildup

A sample piece was moisture-conditioned for one day at 25° C. and 25% RH, passed through an AOT (product of Siemens Elema) with LT-II (a screen produced by Dai Nippon Toryo Co., Ltd.) under the same conditions, and developed to check for the formation of static marks.

II. Determination of the degree of screen deterioration

A sample piece and LT-II (a screen produced by Dai Nippon Toryo C., Ltd.) were moisture-conditioned for one day at 30° C. and 80% RH, and a hundred pieces were passed through a cassette with LT-II under the same conditions, and X-rayed to check for the presence of any strain or blur.

III. Determination of the amount of transfer to a roller

A sample piece was set on a web handling apparatus comprising a drive means for rubber rollers (10 cm in diameter) and ten chrome-plated rollers and transported under a tension of 5 kg at 50 m/min for 30 minutes at ordinary temperature and humidity. The presence of dust or dirt on the rollers was checked.

TABLE 1

| Sample No. | Polymer-1 (mg/m²) | Compound (I)-1 (mg/m²) | Compound (II)-1 (mg/m²) | Control* of Static Buildup | Screen** Deterio-ration | Amount of*** Roller Transfer |
|---|---|---|---|---|---|---|
| 1 | — | — | — | C | A | A |
| 2 | 300 | — | — | C | B | B |
| 3 | — | 50 | — | C | C | B |
| 4 | — | — | 4 | C | B | B |
| 5 (this invention) | 300 | 50 | 4 | A | A | A |
| 6 | 300 | 50 | — | C | C | C |
| 7 | — | 50 | 4 | C | B | B |
| 8 | 300 | — | 4 | C | B | B |

*Control of static buildup
A: Few static marks were observed.
B: Many static marks were observed.
C: Static marks were observed throughout.
**Screen deterioration
A: Stain or blur was not produced.
B: Stain and blur were appreciable.
C: Stain and blur were produced throughout.
***Amount of roller transfer
A: No dust or dirt was stuck on a roller.
B: Sticking of dust or dirt on a roller was appreciable.
C: Dust or dirt stuck all over a roller.

As is clear from Table 1, the combination of a polymer acid, a compound of the formula (I), and a compound of the formula (II) provides an X-ray film on which the static buildup is effectively controlled, and which causes no problem with respect to screen deterioration or transfer to roller.

EXAMPLE 2

Sample (11) was prepared in the same manner as used in preparing Sample (1) in Example 1. Samples (12) through (18) were the same as Sample (11) except that they used a protective layer that contained Polymer-4, Compounds (I)-3, and (II)-3 (wherein 80 mol% of the carboxylic acid group of Polymer-4 was neutralized with KOH), were used in the amounts indicated in Table 2 below. These samples were evaluated for their efficiency in control of static building and degree of screen deterioration in the same manner as described previously. The results are set forth in Table 2.

TABLE 2

| Sample No. | Polymer-4 (mg/m²) | Com-pound (I)-2 (mg/m²) | Compound (II)-3 (mg/m²) | Control of Static Buildup | Screen Deterio-ration |
|---|---|---|---|---|---|
| 11 | — | — | — | C | A |
| 12 | 400 | 50 | 2 | A | A |
| 13 | 1,000 | 50 | 2 | A | A |
| 14 | 6,000 | 50 | 2 | A | C |
| 15 | 400 | 600 | 2 | B | C |
| 16 | 400 | 50 | 30 | A | A |
| 17 | 400 | 50 | 60 | C | C |
| 18 | 400 | 50 | — | C | C |

As is clear from Table 2, the optimum range of the content of the three compounds of this invention is as follows: from 50 to 5,000 mg/m² for the polymer acid, from 5 to 500 mg/m² for the compound of the formula (I), and from 0.5 to 50 mg/m² for the compound of the formula (II).

EXAMPLE 3

Samples (21) through (24), each comprising a triacetyl cellulose film base a first side of which was coated with, in the order stated, a backing layer and a protective layer for the backing layer, and, on the second side of which was coated with, in the order stated, an antihalation layer, a red-sensitive layer, an interlayer, a green-sensitive layer, a yellow filter layer, a blue-sensitive layer, and a protective layer, were prepared according to a conventional coating and drying method. The basic formulations of the respective layers were as follows:

On First Side:

(Backing layer)

Binder: 6.2 g/m² of gelatin
Salt: 0.1 g/m² of potassium nitrate
Hardener: 0.6 g of bis(vinylsulfonylmethyl)ether per 100 g of binder (Backing protective layer)

Binder: 2.2 g/m² of gelatin
Matting agent: 20 mg/m² of polymethyl methacrylate (average particle size: 2.5μ)
Hardener: 1.2 g of bis(vinylsulfonylmethyl)ether per 100 g of binder
Coating agent: 60 mg/m² of

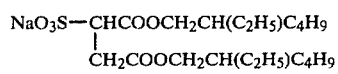

On Second Side:

(Antihalation layer)

Binder: 4.4 g/m² gelatin
Hardener: 5 g of bis(vinylsulfonylmethyl)-ether per 100 g of binder
Coating aid: 4 mg/m² of sodium dodecylbenzenesulfonate
Effective component: 0.4 g/m² of black colloidal silver (Red-sensitive layer)

Binder: 7 g/m² of gelatin
Hardener: 0.7 g of sodium 2-hydroxy-4,6-dichloro-s-triazine per 100 g of binder + 2 g of bis(vinylsulfonylmethyl)ether per 100 g of binder
Coating aid: 10 mg/m² of sodium dodecylbenzenesulfonate
Silver coating: 3.1 g/m²
Silver halide: 2 mol% of AgI + 98 mol% of AgBr Fog restrainer: 0.9 g of 4-hydroxy-6-methyl-1,3,3a,7-tetrazaindene per 100 g of Ag Coupler: 38 g of 1-hydroxy-4-(2-acetylphenyl)azo-N-[4-(2,4-di-tert-amylphenoxy)butyl]-2-naphthamide per 100 g of Ag Sensitizing dye: 0.3 g of pyridinium salt of anhydro-5,5'-dichloro-9-ethyl-3,3'-di(3-sulfopropyl)thiacarboxyanine hydroxide per 100 g of Ag (Interlayer)

Binder: 2.6 g/m$^2$ of gelatin

Hardener: 6 g of bis(vinylsulfonylmethyl)ether per 100 g of binder

Coating aid: 12 mg/m$^2$ of sodium dodecylbenzenesulfonate (Green-sensitive layer)

Binder: 6.4 g/m$^2$ of gelatin

Hardener: 0.7 g of sodium 2-hydroxy-4,6-dichloro-s-triazine per 100 g of binder + 2 g of bis(vinylsulfonylmethyl)ether per 100 g of binder Coating aid: 9 mg/m$^2$ of sodium dodecylbenzenesulfonate Silver coating: 2.2 g/m$^2$ Silver halide: 3.3 mol% of AgI + 96.7 mol% of AgBr Stabilizer: 0.6 g of 4-hydroxy-6-methyl-1,3,3a,7-tetrazaindene per 100 g of Ag Coupler: 37 g of 1-(2,4,6-trichlorophenyl)-3-{3-[(2,4-di-tert-amylphenoxy)acetamido]benzamido}-4-(4-methoxyphenyl)azo-5-pyrazolone per 100 g of Ag Sensitizing dye: 0.3 g of pyridinium salt of anhydro-5,5'-diphenyl-9-ethyl-3,3'-di(2-sulfoethyl)oxacarbocyanine hydroxide per 100 g of Ag (Yellow filter layer)

Binder: 2.3 g/m$^2$ of gelatin

Filter component: 0.7 g/m$^2$ of yellow colloidal silver

Hardener: 5 g of bis(vinylsulfonylmethyl)ether per 100 g of binder

Surfactant: 7 mg/m$^2$ of sodium bis(2-ethylhexyl)-2-sulfonatosuccinate (Blue-sensitive layer)

Binder: 7 g/m$^2$ of gelatin

Hardener: 0.7 g of sodium 2-hydroxy-4,6-dichloro-s-triazine per 100 g of binder + 2 g of bis(vinylsulfonylmethyl)ether per 100 g of binder Coating aid: 8 mg/m$^2$ of sodium dodecylbenzenesulfonate Silver coating: 2.2 g/m$^2$ Silver halide: 3.3 mol% of AgI + 96.7 mol% of AgBr Stabilizer: 0.4 g of 4-hydroxy-6-methyl-1,3,3a,7-tetrazaindene per 100 g of Ag Coupler: 45 g of 2'-chloro-5'-[2-(2,4-di-tertamylphenoxy)butyramido]-α-(5,5'-dimethyl-2,4-dioxo-3-oxazolidinyl)-α-(4-methoxybenzoyl) acetanilide per 100 g of Ag (Protective layer)

Binder: 2 g/m$^2$ of gelatin + 0.3 g/m$^2$ of a styrene-maleic anhydride copolymer (1:1) having an average molecular weight of about 100,000

Hardener: 5 g of bis(vinylsulfonylmethyl)ether per 100 g of binder

Coating aid: 5 g/m$^2$ of sodium dioctylsulfosuccinate

Matting agent: 500 mg/m$^2$ of silver halide matting agent (average particle size: 2μ) as AgBr Sample (21) used only these layers. Sample (22) was identical with Sample (21), except that it used a backing layer containing the Polymer-2 (350 mg/m$^2$), Compound (I)-6 (75 mg/m$^2$), and Compound (II)-5 (5 mg/m$^2$), where Polymer-2 was neutralized to a pH of 7.0 with sodium hydroxide. Sample (23) was identical with Sample (21), except that it used a backing layer containing 250 mg/m$^2$ of Polymer-19, 3 mg/m$^2$ of

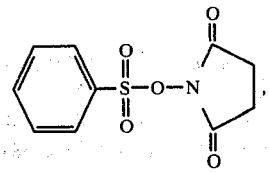

50 mg/m$^2$ of Compound (I)-3 and 10 mg/m$^2$ of Compound (II)-8, where Polymer-19 was neutralized to a pH of 6.5 with sodium hydroxide. Sample (24) was identical with Sample (21), except that it used a backing layer containing 400 mg/m$^2$ of Polymer-1, 100 mg/m$^2$ of Compound (I)-14 and 5 mg/m$^2$ of Compound (II)-2, where Polymer-1 was neutralized with potassium hydroxide to a pH of 6.5.

These samples were evaluated for their efficiency in control of static buildup and amount of transfer to roller by the method used in Example 1. The results are shown in Table 3 below.

TABLE 3

| Sample | Control of Static Buildup | Amount of Roller Transfer |
|---|---|---|
| (21) | C | A |
| (22) | A | A |
| (23) | A | A |
| (24) | A | A |

The results show that the compounds of this invention provide a film that is transferred to a roller in a much smaller amount than when known compounds according to the prior art are used, and that static buildup on the film is controlled very effectively.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material containing a film-forming water-soluble polymer derived from a monomer including a carboxylic acid group;

a compound of the formula (I)

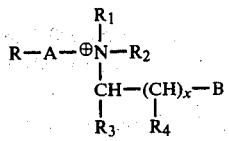

(I)

wherein A is

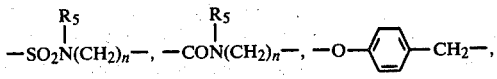

or a chemical bond; R is a saturated or unsaturated hydrocarbon group having from 8 to 22 carbon atoms when A is a chemical bond, and a saturated or unsaturated hydrocarbon group having from 7 to 21 carbon atoms when As is

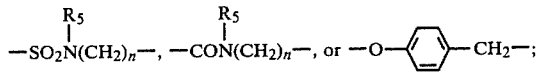

$R_5$ is hydrogen, a methyl group, or an ethyl group; B is $-COO^{\ominus}$ or $-SO_3^{\ominus}$; $R_1$ and $R_2$ are each an alkyl group or hydroxyalkyl group having from 1 to 18 carbon atoms, or a polyalkylene oxide chain group; $R_3$ and $R_4$ are each hydrogen or an alkyl group having from 1 to 4 carbon atoms; n is an integer of from 2 to 8; and x is 0 or 1; and a compound of the formula (II)

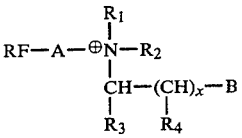

(II)

wherein A, B, $R_1$, $R_2$, $R_3$, $R_4$ and x can have the same meanings as defined for formula (I) above; Rf is a perfluoroalkyl or perfluoroalkenyl group having from 8 to 22 carbon atoms when A is a chemical bond, and a perfluoroalkyl group having from 7 to 21 carbon atoms when A is

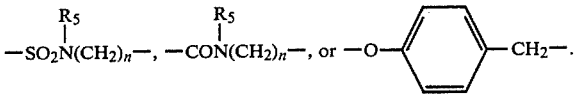

2. A silver halide photographic light-sensitive material as in claim 1 wherein the film-forming watersoluble polymer is a homopolymer or copolymer of a vinyl monomer including a carboxyl group.

3. A silver halide photographic light-sensitive material as in claim 2 wherein said vinyl monomer including a carboxyl group is selected from the group consisting of acrylic acid, methacrylic acid, maleic anhydride, cinnamic acid, crotonic acid, cirtaconic acid, p-carboxystyrene, and vinyl-α-carboxymethylether.

4. A silver halide photographic light-sensitive material as in claim 1, 2, or 3 wherein the molecular weight of the polymer is within the range of from about 5,000 to 500,000.

5. A silver halide photographic light-sensitive material as in claim 1, 2, or 3 wherein the molecular weight is within the range of from about 10,000 to 200,000.

6. A silver halide photographic light-sensitive material as in claim 1, 2, or 3 wherein the film-forming water-soluble polymer is used in an amount from about 50 mg/m$^2$ to 5 g/m$^2$.

7. A silver halide photographic light-sensitive material as in claim 1, 2, or 3 wherein the film-forming water-soluble polymer is used in an amount from about 100 mg/m$^2$ to 1 g/m$^2$.

8. A silver halide photographic light-sensitive material as in claim 1 wherein for the compound of formula (I) A is

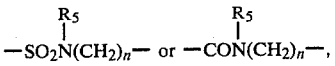

$R_5$ is hydrogen, B is $-COO^{\ominus}$, $R_1$ and $R_2$ are each an alkyl group having from 1 to 4 carbon atoms, a hydroxyalkyl group having from 2 to 4 carbon atoms, or polyethylene oxide chain group, $R_3$ and $R_4$ are each hydrogen or a methyl group, and n is an integer of from 2 to 4.

9. A silver halide photographic light-sensitive material as in claim 1 or 8 wherein the compound of formula (I) is used in an amount of from about 5 to 500 mg/m$^2$.

10. A silver halide photographic light-sensitive material as in claim 1 or 8 wherein the compound of formula (I) is used in an amount of from 10 to 200 mg/m$^2$.

11. A silver halide photographic light-sensitive material as in claim 1 wherein for the compound of formula (II) A is

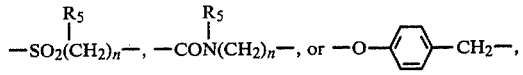

$R_5$ is hydrogen, B is $-COO^{\ominus}$, $R_1$ and $R_2$ are each an alkyl group having from 1 to 4 carbon atoms, $R_3$ and $R_4$ are each hydrogen, and n is an integer of from 2 to 4.

12. A silver halide photographic light-sensitive material as in Claim 1 or 11 wherein the compound of formula (II) is used in an amount of from 0.5 to 50 mg/m$^2$.

13. A silver halide photographic light-sensitive material as in claim 1 or 11 wherein the compound of formula (II) is used in an amount of from 1 to 30 mg/m$^2$.

14. A silver halide photographic light-sensitive material as in claim 1, 2, 3, 8, or 11 wherein the weight ratio of the compound of formula (II) to the compound of formula (I) to the polymer is 1:3 to 150:10 to 1,000.

15. A silver halide photographic light-sensitive material as in claim 1, 2, 3, 8, or 11 wherein the weight ratio of the compound of formula (II) to the compound of formula (I) to the polymer is 1:10 to 150:30 to 300.

16. A silver halide photographic light-sensitive material as in claim 1, 2, 3, 8, or 11 wherein the polymer, the compound of formula (I), and the compound of formula (II) are incorporated together in a surface protective layer, a backing layer, or an interlayer.

17. A silver halide photographic light-sensitive material as in claim 16 wherein the polymer, the compound of formula (I) and the compound of formula (II) are incorporated together in the outermost layer of the photographic material.

18. A silver halide photographic light-sensitive material as in claim 1, 2, 3, 8, or 11 wherein the compound of formula (I) and the compound of formula (II) are incorporated in the outermost layer of the photographic material, and the polymer is incorporated in an adjacent layer.

19. A silver halide photographic light-sensitive material as in claim 1, 2, 3, 8, or 11 wherein the polymer is present in an amount of from 5 to 5,000 mg/m$^2$, the compound of formula (I) is present in an amount of from 5 to 500 mg/m$^2$, and the compound of formula (II) is present in an amount from 0.5 to 50 mg/m$^2$.

* * * * *